US009969958B2

(12) United States Patent
Dotzauer et al.

(10) Patent No.: US 9,969,958 B2
(45) Date of Patent: May 15, 2018

(54) CONCENTRATED DETERGENT COMPOSITION FOR THE IMPROVED REMOVAL OF STARCH IN WAREWASHING APPLICATIONS

(71) Applicant: Ecolab USA, Inc., St. Paul, MN (US)

(72) Inventors: David Dotzauer, St. Paul, MN (US); Tobias Foster, Cologne (DE); David W. Gohl, Eagan, MN (US); Dirk Kullwitz, Tonisworst (DE); John Mansergh, Cottage Grove, MN (US)

(73) Assignee: Ecolab USA Inc., Saint Paul, MN (US)

( * ) Notice: Subject to any disclaimer, the term of this patent is extended or adjusted under 35 U.S.C. 154(b) by 105 days.

(21) Appl. No.: 14/888,537

(22) PCT Filed: May 2, 2013

(86) PCT No.: PCT/EP2013/059159

§ 371 (c)(1),
(2) Date: Nov. 2, 2015

(87) PCT Pub. No.: WO2014/177217

PCT Pub. Date: Nov. 6, 2014

(65) Prior Publication Data

US 2016/0075973 A1 Mar. 17, 2016

(51) Int. Cl.

| | |
|---|---|
| ***C11D 3/10*** | (2006.01) |
| ***C11D 3/16*** | (2006.01) |
| ***C11D 3/39*** | (2006.01) |

(52) U.S. Cl.

CPC ..... *C11D 3/10* (2013.01); *C11D 3/168* (2013.01); *C11D 3/3932* (2013.01); *C11D 3/3942* (2013.01); *C11D 3/3947* (2013.01)

(58) Field of Classification Search

CPC ..... C11D 3/10

See application file for complete search history.

(56) References Cited

U.S. PATENT DOCUMENTS

| | | | | |
|---|---|---|---|---|
| 5,246,612 | A * | 9/1993 | Van Dijk | C11D 3/3932 252/186.38 |
| 5,833,755 | A | 11/1998 | Schlom et al. | |
| 5,972,040 | A * | 10/1999 | Moss | C11D 1/83 510/224 |
| 6,140,294 | A * | 10/2000 | Delroisse | B01J 31/1815 252/186.28 |
| 7,094,746 | B2 | 8/2006 | Lentsch et al. | |
| 8,101,027 | B2 * | 1/2012 | Vandermeulen | C11D 1/66 134/25.2 |
| 2004/0048763 | A1 * | 3/2004 | Busch | C11D 3/3932 510/302 |
| 2010/0249007 | A1 * | 9/2010 | Holderbaum | C11D 3/3907 510/220 |

(Continued)

FOREIGN PATENT DOCUMENTS

| | | |
|---|---|---|
| DE | 102007059968 A1 | 6/2009 |
| DE | 102008045215 A1 | 3/2010 |

(Continued)

OTHER PUBLICATIONS

Hage et al., "Applications of Transition-Metal Catalysts to Textile and Wood-Pulp Bleaching", Angewandte Chemie, 17 pages, issued on Jan. 1, 2006.

Hage et al., "Efficient manganese catalysts for low-temperature bleaching", Letters to Nature, 3 pages, issued on Jun. 23, 1994.

PCT, "International Search Report", issued in connection to International Application No. PCT/EP2013/059159, 4 pages, dated Jan. 29, 2014.

Reinhardt et al., "MnTACN—A New Catalyst in Automatic Dishwashing Applications", Detergents Automatic Dishwashing, 10 pages, issued on Oct. 1, 2012.

PCT, "Written Opinion of the International Searching Authority", issued in connection to International Application No. PCT/EP2013/059159, 5 pages, dated Feb. 3, 2014.

(Continued)

*Primary Examiner* — Nicole M Buie-Hatcher
*Assistant Examiner* — M. Reza Asdjodi
(74) *Attorney, Agent, or Firm* — McKee, Voorhees & Sease, PLC

(57) ABSTRACT

The invention provides a concentrated detergent composition comprising alkali metal carbonate, alkali metal percarbonate, and a peroxidation catalyst according to formula (I) $[(L_pM_q)_nX_r]Y_s$, wherein each L independently is an organic ligand containing at least three nitrogen atoms that coordinate with the metal M;

M is Mn or Fe; each X independently is a coordinating or bridging group selected from the group consisting of $H_2O$, $OH^-$, $SH^-$, $HO_2^-$, $O^{2-}$, $O_2^{2-}$, $S^{2-}$, $F^-$, $Cl^-$, $Br^-$, $I^-$, $NO_3^-$, $NO_2^-$, $SO_4^{2-}$, $SO_3^{2-}$, $PO_4^{3-}$, $N_3^-$, $CN^-$, $NR_3$, $NCS^-$, RCN, $RS^-$, $RCO_2^-$, $RO^-$, and with R being hydrogen or a $C_1$ to $C_6$ alkyl group; p is an integer from 1 to 4; q is an integer from 1 to 2; r is an integer from 0 to 6; Y is a counter ion; and s is the number of counter ions. The invention also relates to the use of said concentrated detergent composition as a warewashing detergent for the removal of starch soil.

17 Claims, 2 Drawing Sheets

(56) References Cited

U.S. PATENT DOCUMENTS

| | | | | |
|---|---|---|---|---|
| 2011/0005007 | A1* | 1/2011 | Brooker | C11D 3/168 8/137 |
| 2011/0166055 | A1* | 7/2011 | Reinhardt | C11D 3/3932 510/220 |
| 2016/0075973 | A1* | 3/2016 | Dotzauer | C11D 3/10 510/218 |

FOREIGN PATENT DOCUMENTS

| | | | | |
|---|---|---|---|---|
| DE | 102010028742 | A1 | 11/2011 | |
| EP | 0509787 | A2 | 10/1992 | |
| EP | 0530870 | A1 | 10/1993 | |
| EP | 1001009 | A1 | 5/2000 | |
| EP | 1741774 | A1 | 10/2007 | |
| WO | 1994021777 | A1 | 9/1994 | |
| WO | WO 9421777 | A1 * | 9/1994 | C11D 3/3905 |
| WO | 9722681 | A1 | 6/1997 | |
| WO | 1997044417 | A1 | 11/1997 | |
| WO | 025740 | A1 | 3/2012 | |
| WO | 2012025740 | A1 | 3/2012 | |
| WO | WO 2012025740 | A1 * | 3/2012 | C11D 3/33 |

OTHER PUBLICATIONS

Reinhardt et al., "Manganese Oxalate—A Bio-Inspired Bleach Catalyst", SOFW Journal, 7 pages, issued on Sep. 1, 2011.

Reinhardt et al., "Mn TACN—A New Catalyst in Automatic Dishwashing Applications", SOFW Journal, 8 pages, issued on Oct. 1, 2012.

* cited by examiner

CONCENTRATED DETERGENT COMPOSITION FOR THE IMPROVED REMOVAL OF STARCH IN WAREWASHING APPLICATIONS

CROSS-REFERENCE TO RELATED APPLICATION

This application claims priority as a national stage application under 35 U.S.C. 371 to PCT/EP2013/059159 filed May 2, 2013. The entire contents of this patent application are hereby expressly incorporated herein by reference including, without limitation, the specification, claims, and abstract, as well as any figures, tables, or drawing thereof.

FIELD OF THE INVENTION

The present invention relates to concentrated detergent compositions for warewashing, especially adapted for the removal of starch.

BACKGROUND OF THE INVENTION

Conventional warewashing detergents are normally phosphate-based, highly alkaline compositions comprising a chlorine bleach. However, the high alkalinity and the chlorine bleach have proved to be too aggressive and hazardous for common use. Further, the use of phosphate and phosphorus containing compounds is discouraged due to environmental concerns. There is therefore a growing interest to replace these compositions with less alkaline compositions, which do not contain phosphate and which use a milder bleach instead of chlorine bleach.

It is known in the art to replace chlorine bleach with milder peroxide bleaches such as sodium perborate or sodium percarbonate. To compensate the reduced performance of said bleaches, an organic activator or bleach precursor can be added, which reacts with the perborate or percarbonate to form an organic peroxyacid. A well-known bleach activator is N,N,N',N'-tetraacetylethylenediamine (TAED).

To further increase the performance of warewashing compositions, U.S. Pat. No. 5,246,612 has suggested to use a dinuclear manganese complex in combination with a peroxygen compound.

The combination of a manganese complex as bleach catalyst and a peroxygen compound has also been disclosed in the context of a laundry detergent bleach powder composition in EP 0 509 787 A2.

As an alternative for the highly alkaline detergent compositions, mild alkaline detergent materials have been developed on the basis of sodium carbonate as a source of alkalinity (see for example U.S. Pat. No. 7,094,746 B2). These compositions provide mechanically stable solid carbonate detergent products having equivalent cleaning performance when compared to caustic based detergents, but are considerably less alkaline.

Against this background there is still the need to develop further warewashing detergents specifically tailored towards institutional warewashing applications. One of the key objectives here is to deal with coffee and tea stains as well as with starch soil.

The technical object of the present invention therefore is to provide a warewashing detergent composition that is not phosphate-based, of mild alkalinity, and is highly effective for the removal of starch soil.

It has surprisingly been found that a composition comprising an alkali metal carbonate as a source of alkalinity, an alkali metal percarbonate as a peroxygen bleach compound, and an iron or manganese complex as peroxidation catalyst provides a highly efficient warewashing detergent for the removal of starch soil.

BRIEF SUMMARY OF THE INVENTION

The present invention provides concentrated detergent compositions for warewashing, especially adapted for the removal of starch. The concentrated detergent compositions comprises alkali metal carbonate, alkali metal percarbonate, and a peroxidation catalyst.

Figure 1:
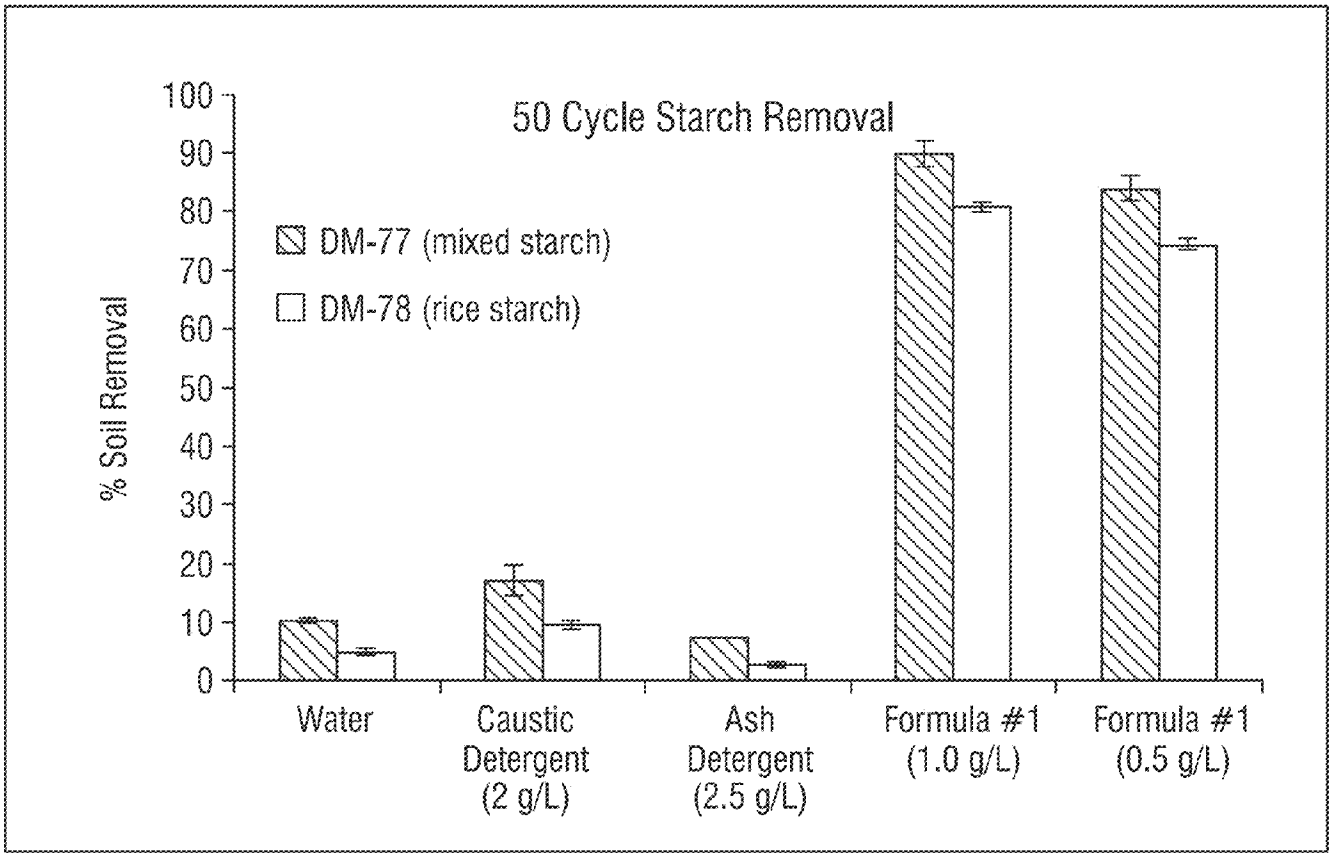
FIG. 1 shows the starch removal performance for 50 cycles using detergent compositions according to embodiments of the invention.

FIG, 2 shows the starch removal performance for 10 cycles using detergent compositions according to embodiments of the invention.

DETAILED DESCRIPTION OF THE INVENTION

The present invention therefore provides a concentrated detergent composition comprising alkali metal carbonate, alkali metal percarbonate, and a peroxidation catalyst according to formula (I)

$$[(L_pM_q)_nX_r]Y_s \quad (I)$$

wherein each L independently is an organic ligand containing at least three nitrogen atoms and/or at least two carboxyl groups that coordinate with the metal M;

M is Mn or Fe;

each X independently is a coordinating or bridging group selected from the group consisting of $H_2O$, $OH^-$, $SH^-$, $HO_2^-$, $O^{2-}$, $O_2^{2-}$, $S^{2-}$, $F^-$, $Cl^-$, $Br^-$, $I^-$, $NO_3^-$, $NO_2^-$, $SO_4^{2-}$, $SO_3^{2-}$, $PO_4^{3-}$, $N_3^-$, $CN^-$, $NR_3$, $NCS^-$, RCN, $RS^-$, $RCO_2^-$, $RO^-$, and

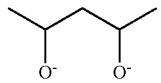

with R being hydrogen or a $C_1$ to $C_6$ alkyl group;

p is an integer from 1 to 4;

q is an integer from 1 to 2;

r is an integer from 0 to 6;

Y is a counter ion;

and s is the number of counter ions.

While it is known to use Mn and Fe as peroxidation catalysts, providing the metal in the form of a complex according to formula (I) has several advantages such as increasing the activity and the stability of the complex. In particular in the case of Mn complexes, the ligands L help to increase the solubility of the metal.

In a particularly preferred example the peroxidation catalyst is a dinuclear complex according to formula (II)

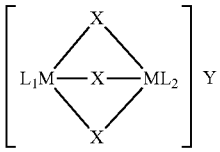

wherein $L_1$ and $L_2$ can either be separate ligands or where $L_1$ and $L_2$ can combine to be a single molecule.

Among the coordinating or bridging groups, the groups $O^{2-}$, $O_2^{2-}$, $CH_3O$—, $CH_3CO^{2-}$,

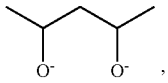

or Cl— are particularly preferred.

Preferably, the ligands are selected from the group consisting triazacyclononane, triazacyclononane derivatives, Schiff-base containing ligands, polypyridineamine ligands, pentadentate nitrogen-donor ligands, bispidon-type ligands, and macrocyclic tetraamidate ligands. Examples for those classes of ligands are described by R. Hage and A Lienke (Hage, Ronald; Lienke, Achim. Applications of Transition-Metal Catalysts to Textile and Wood-Pulp Bleaching. Angewandte Chemie International Edition, 2005, 45. Jg., Nr. 2, pp. 206-222).

Another group of preferred ligands are dicarboxylates, in particular oxalate.

Particularly preferred ligands are the compounds according to formulae (II) to (IV)

(II)

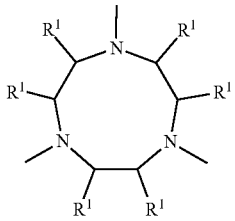

(III)

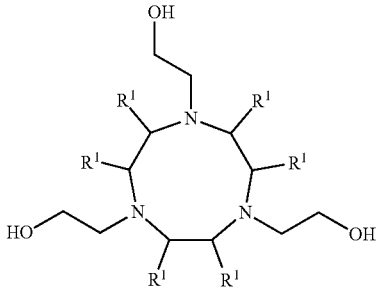

(IV)

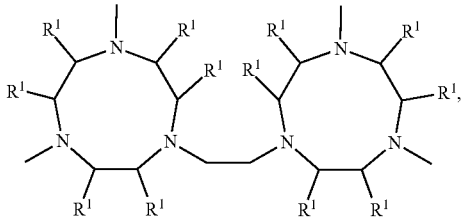

wherein each $R^1$ independently is hydrogen or a $C_1$ to $C_6$ alkyl group.

Other suitable ligands are the compounds according to formulae (V) to (XVIII)

(V)

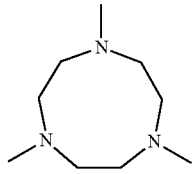

(VI)

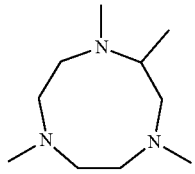

(VII)

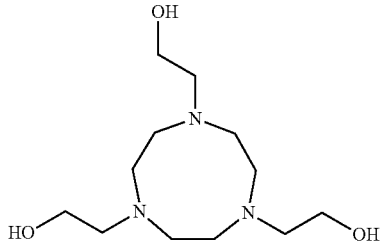

(VIII)

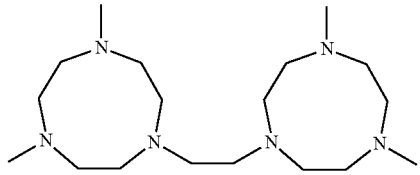

(IX)

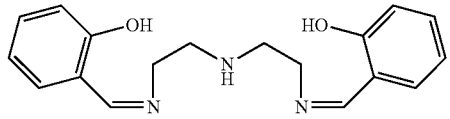

(X)

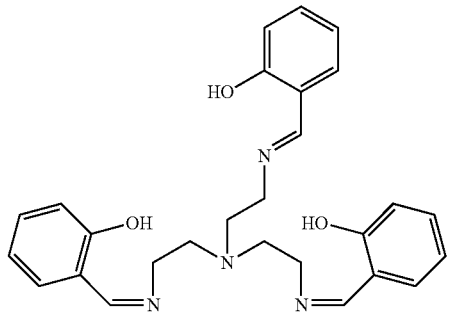

-continued (XI)

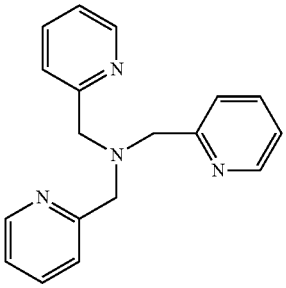

(XII)

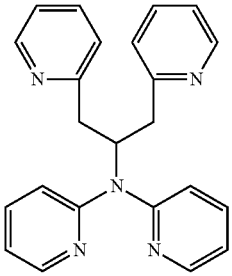

(XII)

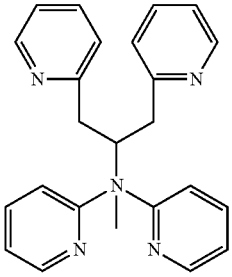

(XIII)

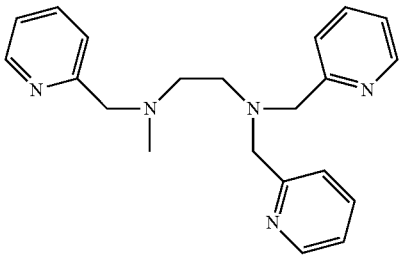

(XIV)

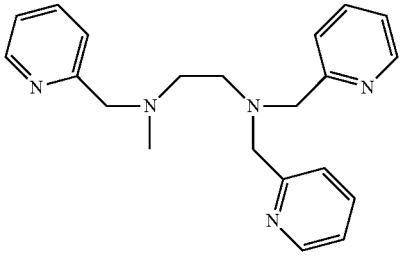

-continued (XV)

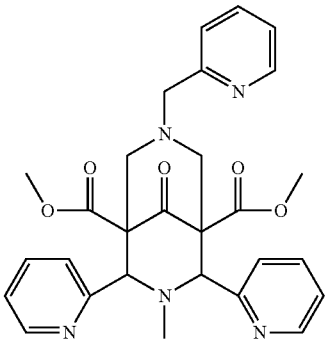

(XVI)

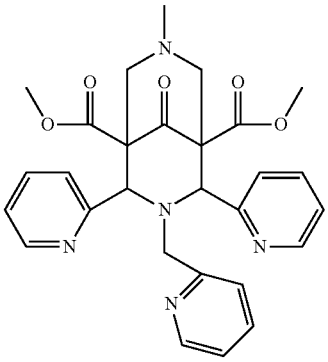

(XVII)

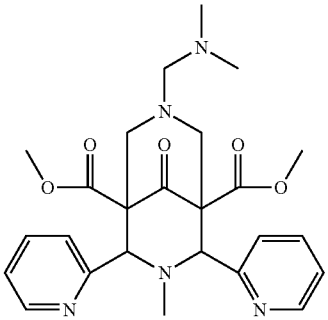

(XVIII)

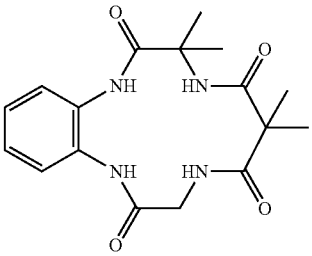

The ligands (V) to (X) are particularly suited if the metal M is Mn. The ligands (XII) to (XVIII) are particularly well-suited if the metal M is Fe. Ligand (XI) is equally suited for Mn and Fe.

The counter ion Y is selected depending on the charge of the complex $[(L_pM_q)_nX_r]$. The number of counter ions s is equal to the number of counter ions required to achieve charge neutrality. Preferably the number of counter ions s is 1 to 3. The type of counter ion Y for charge neutrality is not critical for the activity of the complex and can be selected from, for example, the group consisting of $Cl^-$, $Br^-$, $I^-$, $NO_3^-$, $ClO_4^-$, $NCS^-$, $BPh_4^-$, $BF_4^-$, $PF_6^-$, $R^2—SO_3^-$, $R^2$—$SO_4^-$, and $R^2$—$CO_2^-$, wherein $R^2$ is hydrogen or a $C_1$ to $C_4$ alkyl group. Particularly preferred counter ions are $PF_6^-$ and $ClO_4^-$.

In an especially preferred embodiment, the peroxidation catalyst is a complex according to formula (II), wherein M is manganese, X is selected from the group consisting of $O^{2-}$, $O_2^{2-}$, $CH_3O$—, $CH_3CO^{2-}$,

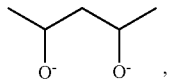

or Cl—, and the ligand L is a compound according to formulae (II) and/or (IV).

A peroxidation catalyst, wherein M is manganese and L is oxalate, is also preferred.

Particularly preferred peroxidation catalysts are the compounds according to formulae (XIX) and (XX), also referred to as MnTACN and MnDTNE, respectively.

(XIX)

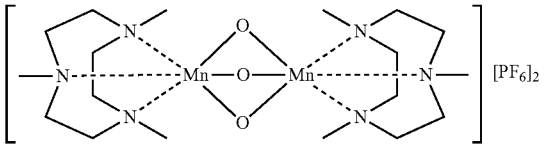

(XX)

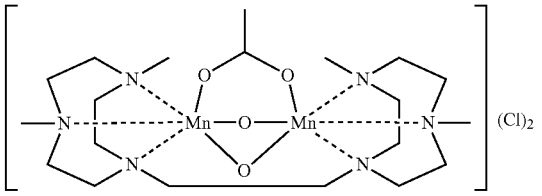

The concentrated detergent composition may comprise 0.0005 to 0.12% by weight of the metal M in the form of a peroxidation catalyst complex, preferably from 0.001 to 0.05% by weight.

The concentrated detergent composition comprises an alkali metal carbonate as a source of alkalinity. The concentrated detergent composition typically comprises at least 5 percent by weight alkali metal carbonate, preferably the composition comprises 10 to 80 percent by weight, more preferably 15 to 70 percent by weight, most preferably 20 to 60 percent by weight alkali metal carbonate.

In general, the concentrated detergent composition comprises an effective amount of alkali metal carbonate. In the context of the present invention, an effective amount of the alkali metal carbonate is an amount that provides a use solution having a pH of at least 8, preferably a pH of 9.5 to 11, more preferably 10 to 10.3. A use solution in the context of the present invention is considered a solution of 1 g/l of the concentrated detergent composition in distilled water. The pH of the use solution is meant to be determined at room temperature.

In a preferred embodiment of the present invention, the concentrated detergent composition therefore provides a pH measured at room temperature of at least 8, preferably a pH of 9.5 to 11, more preferably 10 to 11 when diluted in distilled water at a concentration of 1 gram per liter.

Suitable alkali metal carbonates are for example sodium or potassium carbonate, sodium or potassium bicarbonate, sodium or potassium sesquicarbonate, and mixtures thereof.

Due to the use of an alkali metal carbonate as alkaline source, other alkaline sources such as alkali metal hydroxides are not required. Preferably, the concentrated detergent composition therefore does not comprise alkali metal hydroxides.

The concentrated detergent composition comprises alkali metal percarbonate as a peroxygen compound. It has surprisingly been found that alkali metal percarbonate, when combined with alkali metal carbonate and the peroxidation catalyst of the present invention, efficiently removes starch soil from dishes even at a mildly alkaline pH and a temperature of 50 to 65° C. It has also been found that it is particularly preferable if the concentrated detergent composition comprises 10 to 60% by weight, preferably 36 to 60% by weight, more preferably 40 to 60% by weight, most preferably 40 to 50% by weight alkali metal percarbonate. Suitable alkali metal percarbonates are for example sodium percarbonate and potassium percarbonate.

The concentrated detergent composition of the present invention may further comprise at least one of the compounds selected from the list consisting of surfactants, activating agents, chelating/sequestering agents, silicates, detergent fillers or binding agents, defoaming agents, anti-redeposition agents, enzymes, dyes, odorants, and mixtures thereof.

A variety of surfactants can be used in the present composition, such as anionic, nonionic, cationic, and zwitterionic surfactants. The concentrated detergent composition can comprise 0.5 to 20% by weight surfactant, preferably 1.5 to 15% by weight.

Suitable anionic surfactants are, for example, carboxylates such as alkylcarboxylates (carboxylic acid salts) and polyalkoxycarboxylates, alcohol ethoxylate carboxylates, nonylphenol ethoxylate carboxylates; sulfonates such as alkylsulfonates, alkylbenzenesulfonates, alkylarylsulfonates, sulfonated fatty acid esters; sulfates such as sulfated alcohols, sulfated alcohol ethoxylates, sulfated alkylphenols, alkylsulfates, sulfosuccinates, alkylether sulfates; and phosphate esters such as alkylphosphate esters. Exemplary anionic surfactants include sodium alkylarylsulfonate, alpha-olefinsulfonate, and fatty alcohol sulfates.

Suitable nonionic surfactants are, for example, those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark Pluronic (BASF), and other like nonionic compounds. Silicone surfactants can also be used.

Suitable cationic surfactants include, for example, amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, 2-alkyl-1-(2-hydroxyethyl)-2-imidazoline; and quaternary ammonium salts, as for example, alkylquaternary ammonium chloride surfactants such as n-alkyl($C_{12}$-$C_{18}$)dimethylbenzyl ammonium chloride, n-tetradecyldimethylbenzylammonium chloride monohydrate, naphthylene-substituted quaternary ammonium chloride such as dimethyl-1-naphthylmethylammonium chloride. The cationic surfactant can be used to provide sanitizing properties.

Suitable zwitterionic surfactants include, for example, betaines, imidazolines, and propinates.

If the concentrated detergent composition is intended to be used in an automatic dishwashing or warewashing machine, the surfactants selected, if any surfactant is used, can be those that provide an acceptable level of foaming when used inside a dishwashing or warewashing machine. It should be understood that warewashing compositions for use in automatic dishwashing or warewashing machines are generally considered to be low-foaming compositions.

The concentrated detergent composition may comprise an activating agent in to further increase the activity of the percarbonate. Such an activating agent is used in addition to the peroxidation catalyst. Suitable activating agents include sodium-4-benzoyloxy benzene sulphonate (SBOBS); N,N,N',N'-tetraacetyl ethylene diamine (TAED); sodium-1-methyl-2-benzoyloxy benzene-4-sulphonate; sodium-4-methyl-3-benzoyloxy benzoate; SPCC trimethyl ammonium toluyloxy benzene sulphonate; sodium nonanoyloxybenzene sulphonate, sodium 3,5,5,-trimethyl hexanoyloxybenzene sulphonate; penta acetyl glucose (PAG); octanoyl tetra acetyl glucose and benzoyl tetracetyl glucose. The concentrated detergent composition may comprise an activating agent or a mixture of activating agents at a concentration of 1 to 8% by weight, preferably 2 to 5% by weight.

Suitable chelating/sequestering agents are, for example, citrate, aminocarboxylic acid, condensed phosphate, phosphonate, and polyacrylate. In general, a chelating agent is a molecule capable of coordinating (i.e., binding) the metal ions commonly found in natural water to prevent the metal ions from interfering with the action of the other detersive ingredients of a cleaning composition. In general, chelating/sequestering agents can generally be referred to as a type of builder. The chelating/sequestering agent may also function as a threshold agent when included in an effective amount. The concentrated detergent composition can include 0.1 to 70% by weight, preferably 5 to 60% by weight, more preferably 5 to 50% by weight, most preferably 10 to 40% by weight of a chelating/sequestering agent.

Suitable aminocarboxylic acids include, for example, methylglycinediacetic acid (MGDA), N-hydroxyethyliminodiacetic acid, nitrilotriacetic acid (NTA), ethylenediaminetetraacetic acid (EDTA), N-hydroxyethyl-ethylenediaminetriacetic acid (HEDTA), and diethylenetriaminepentaacetic acid (DTPA).

Examples of condensed phosphates include sodium and potassium orthophosphate, sodium and potassium pyrophosphate, sodium tripolyphosphate, sodium hexametaphosphate, and the like. A condensed phosphate may also assist, to a limited extent, in solidification of the composition by fixing the free water present in the composition as water of hydration.

The composition may include a phosphonate such as 1-hydroxyethane-1,1-diphosphonic acid $CH_3C(OH)[PO(OH)_2]_2$(HEDP); amino tri(methylenephosphonic acid) $N[CH_2PO(OH)_2]_3$; aminotri(methylenephosphonate), sodium salt $(NaO)(HO)P(OCH_2N[CH_2PO(ONa)_2]_2)$; 2-hydroxyethyliminobis(methylenephosphonic acid) $HOCH_2CH_2N[CH_2PO(OH)_2]_2$; diethylenetriaminepenta(methylenephosphonic acid) $(HO)_2POCH_2N[CH_2CH_2N[CH_2PO(OH)_2]_2]_2$; diethylenetriaminepenta(methylenephosphonate), sodium salt $C_9H_{(28-x)}N_3Na_xO_{15}P_5$ (x=7); hexamethylenediamine(tetramethylenephosphonate), potassium salt $C_{10}H_{(28-x)}N_2K_xO_{12}P_4$ (x=6); bis(hexamethylene) triamine(pentamethylenephosphonic acid) $(HO_2)POCH_2N[(CH_2)_6N[CH_2PO(OH)_2]_2]_2$; and phosphorus acid $H_3PO_3$.

Preferred phosphonates are 1-Hydroxy Ethylidene-1,1-Diphosphonic Acid (HEDP), aminotris(methylenephosphonic acid) (ATMP) and Diethylenetriamine penta(methylene phosphonic acid) (DTPMP).

A neutralized or alkaline phosphonate, or a combination of the phosphonate with an alkali source prior to being added into the mixture such that there is little or no heat or gas generated by a neutralization reaction when the phosphonate is added is preferred. The phosphonate can comprise a potassium salt of an organo phosphonic acid (a potassium phosphonate). The potassium salt of the phosphonic acid material can be formed by neutralizing the phosphonic acid with an aqueous potassium hydroxide solution during the manufacture of the solid detergent. The phosphonic acid sequestering agent can be combined with a potassium hydroxide solution at appropriate proportions to provide a stoichiometric amount of potassium hydroxide to neutralize the phosphonic acid. A potassium hydroxide having a concentration of from about 1 to about 50 wt % can be used. The phosphonic acid can be dissolved or suspended in an aqueous medium and the potassium hydroxide can then be added to the phosphonic acid for neutralization purposes.

The chelating/sequestering agent may also be a water conditioning polymer that can be used as a form of builder. Exemplary water conditioning polymers include polycarboxylates. Exemplary polycarboxylates that can be used as water conditioning polymers include polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, and hydrolyzed acrylonitrile-methacrylonitrile copolymers.

The concentrated detergent composition may include the water conditioning polymer in an amount of 0.1 to 20% by weight, preferably 0.2 to 5% by weight.

Silicates may be included in the concentrated detergent composition as well. Silicates soften water by the formation of precipitates that can be easily rinsed away. They commonly have wetting and emulsifying properties, and act as buffering agents against acidic compounds, such as acidic soil. Further, silicates can inhibit the corrosion of stainless steel and aluminium by synthetic detergents and complex phosphates. A particularly well suited silicate is sodium metasilicate, which can be anhydrous or hydrated. The concentrated detergent composition may comprise 1 to 10% by weight silicates.

The composition can include an effective amount of detergent fillers or binding agents. Examples of detergent fillers or binding agents suitable for use in the present composition include sodium sulfate, sodium chloride, starch, sugars, and $C_1$-$C_{10}$ alkylene glycols such as propylene glycol. The detergent filler may be included an amount of 1 to 20% by weight, preferably 3 to 15% by weight.

A defoaming agent for reducing the stability of foam may also be included in the composition to reduce foaming.

When included the defoaming agent can be provided in an amount of 0.01 to 15% by weight.

Suitable defoaming agents include, for example, ethylene oxide/propylene block copolymers such as those available under the name Pluronic N-3, silicone compounds such as silica dispersed in polydimethylsiloxane, polydimethylsiloxane, and functionalized polydimethylsiloxane, fatty amides, hydrocarbon waxes, fatty acids, fatty esters, fatty alcohols, fatty acid soaps, ethoxylates, mineral oils, polyethylene glycol esters, and alkyl phosphate esters such as monostearyl phosphate.

The composition can include an anti-redeposition agent for facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. The anti-redeposition agent can be included in an amount of 0.5 to 10% by weight, preferably 1 to 5% by weight.

The composition may include enzymes that provide desirable activity for removal of protein-based, carbohydrate-based, or triglyceride-based soil. Although not limiting to the present invention, enzymes suitable for the cleaning composition can act by degrading or altering one or more types of soil residues encountered on crockery thus removing the soil or making the soil more removable by a surfactant or other component of the cleaning composition. Suitable enzymes include a protease, an amylase, a lipase, a gluconase, a cellulase, a peroxidase, or a mixture thereof of any suitable origin, such as vegetable, animal, bacterial, fungal or yeast origin. The concentrated detergent composition may comprise 1 to 30% by weight enzymes, preferably 2 to 15% by weight, more preferably 3 to 10% by weight, most preferably 4 to 8% by weight.

Various dyes, odorants including perfumes, and other aesthetic enhancing agents can be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keystone Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), and Acid Green 25 (Ciba-Geigy).

Fragrances or perfumes that may be included in the compositions include, for example, terpenoids such as citronellol, aldehydes such as amyl cinnamaldehyde, a jasmine such as C1S-jasmine or jasmal, and vanillin.

The concentrated detergent composition may be provided, for example, in the form of a solid, a powder, a liquid, or a gel. Preferably, the concentrated detergent composition is provided in the form of a solid or a powder.

The components used to form the concentrated detergent composition can include an aqueous medium such as water as an aid in processing. It is expected that the aqueous medium will help provide the components with a desired viscosity for processing. In addition, it is expected that the aqueous medium may help in the solidification process when is desired to form the concentrated detergent composition as a solid. When the concentrated detergent composition is provided as a solid, it can, for example, be provided in the form of a block or pellet. It is expected that blocks will have a size of at least about 5 grams, and can include a size of greater than about 50 grams. It is expected that the concentrated detergent composition will include water in an amount of 1 to 50% by weight, preferably 2 to 20% by weight.

When the components that are processed to form the concentrated detergent composition are processed into a block, it is expected that the components can be processed by extrusion techniques or casting techniques. In general, when the components are processed by extrusion techniques, it is believed that the concentrated detergent composition can include a relatively smaller amount of water as an aid for processing compared with the casting techniques. In general, when preparing the solid by extrusion, it is expected that the concentrated detergent composition can contain 2 to 10% by weight water. When preparing the solid by casting, it is expected that the amount of water is 20 to 40% by weight.

In a second aspect the present invention also relates to the use of a concentrated detergent composition as described above as a warewashing detergent for the removal of starch soil.

Preferably, the concentrated detergent composition is diluted at a concentration of 0.1 to 10 g/l, preferably 0.5 to 5 g/l, most preferably 1 to 1.5 g/l to provide a use solution.

In a particular preferred embodiment the concentrated detergent composition is used as a warewashing detergent for the removal of starch soil at a temperature of 20 to 85° C., preferably from 50 to 75° C.

The use of the described concentrated detergent composition as a warewashing detergent also allows for short washing times, which is defined as the time the warewashing detergent is contacted with the ware before it is rinsed off Preferably the warewashing detergent is used for a washing time of 10 seconds to 5 minutes, preferably 15 seconds to 2 minutes, more preferably 30 to 60 seconds, most preferably 30 to 45 seconds.

EXAMPLES

The following example illustrates the invention by testing the removal of starch soil from ceramic tiles.

Ceramic bullnose tiles soiled with starch soil without black dye were used for this test.

For the ceramic tile tests, a cleaning performance test was applied comprising three wash cycles, in which 5 tiles were cleaned for each test. The experiments were conducted using a Hobart AM-15 hood-type dish washer with a standard program of 55 sec. total time (45 sec. wash step, 10 sec. rinse step, fill volume of the main wash tank of 53 L, 2.8 L rinse volume). The expected temperatures are 71° C. for the wash step and 82° C. for the rinse step.

The detergent components were added manually to the wash tank before each cycle of the experiment. Thereby, the components added before the first cycle were dissolved within the main wash tank by running the machine for 15 seconds, followed by a waiting time of 5 minutes. Before the experiments, the different raw materials listed in Table 1 were weighed out individually and added to the dish machine for each cleaning cycle.

TABLE 1

Composition of experimental formula 1. ATMP is aminotris(methylenephosphonic acid), and Mn-TACN is a peroxidation catalyst according to formula (XIX). The pH of a 1 g/l solution of experimental formula 1 in distilled water was 10.1 to 10.3.

| Raw material | Experimental Formula 1 (% by weight) |
|---|---|
| Sodium carbonate | 34.25 |
| Sodium citrate dehydrate | 10 |
| Sodium metasilicate | 3.12 |
| Block copolymer based on ethylene oxide and propylene oxide | 5 |
| Polyethylene glycol | 2 |
| Acrylic acid homopolymers | 5 |
| 50% ATMP | 0.58 |
| Sodium percarbonate | 40 |
| Mn-TACN catalyst | 0.05 |

For the experiments, ceramic tiles were soiled with a corn starch suspension that was heated until thickened and then applied to the ceramic tiles.

After the cleaning procedure the starch tiles were stained using an iodine solution to make visible any remaining starch film. The stained tiles were imaged using a color scanner, and the images were analyzed by ImageJ software in order to determine the level of starch removal.

For the image analysis, the tile images were converted to 16-bit grayscale images and the average grayscale value was determined for each tile. A completely clean tile would have a grayscale value of 255, while a completely black tile would have a grayscale value of 0. Ratings were then given to each experiment based on the relative grayscale value compared to control tests using water and caustic detergent. The rating scale used for rating the tiles is shown in Table 2.

TABLE 2

Rating scale of the starch removal experiments.

| Rating scale | Value |
|---|---|
| Removal is less than or equal to water | 1 |
| Removal is similar to 1000 ppm of caustic detergent | 2 |
| Removal is better than 1000 ppm of caustic detergent but less than 2000 ppm of caustic detergent | 3 |
| Removal is similar to 2000 ppm of caustic detergent | 4 |
| Removal is better than 2000 ppm of caustic detergent | 5 |

A number of tests were performed with individual components from experimental formula 1 (Table 1). The results of these tests are shown in Table 3. The results demonstrate that the inventive combination of sodium carbonate, sodium percarbonate, and catalyst (examples 7 and 12) leads to an improvement in starch removal even when compared to 2000 ppm of caustic detergent.

TABLE 3

Results of the cleaning performance test on ceramic test tiles. The samples in examples 4 to 6 were produced by mixing the respective components at amounts equal to the amounts used in a 1.5 g/L dose of formula 1 (Table 1).

| Example | Sample | Grayscale Value | Rating |
|---|---|---|---|
| 1 | Water | 191.2 | 1 |
| 2 | 1000 ppm caustic detergent | 193.7 | 2 |

TABLE 3-continued

Results of the cleaning performance test on ceramic test tiles. The samples in examples 4 to 6 were produced by mixing the respective components at amounts equal to the amounts used in a 1.5 g/L dose of formula 1 (Table 1).

| Example | Sample | Grayscale Value | Rating |
|---|---|---|---|
| 3 | 2000 ppm caustic detergent | 217.8 | 4 |
| 4 | Sodium carbonate, sodium percarbonate | 195.6 | 2 |
| 5 | Sodium carbonate, Mn-TACN | 191.0 | 1 |
| 6 | Sodium carbonate, sodium percarbonate, Mn-TACN | 234.1 | 5 |
| 7 | 1.5 g/l experimental formula 1 | 238.3 | 5 |

The caustic detergent was a composition comprising 17.65% by weight water, 37.9% by weight sodium hydroxide, 42% by weight amino carboxylate, 1.2% by weight ethoxylated nonionic surfactant, and 1.25% by weight polyacrylate.

Additional cleaning performance tests were conducted with commercially available starch-coated melamine tiles (Testfabrics Inc.). The tiles were coated either with mixed starch (DM-77) or rice starch (DM-78). The starch soil on these tiles is much more difficult to remove than the starch soil on the ceramic tiles, thus requiring the use of more cycles. Tests with these melamine tiles often require more than 50 cycles to get substantial starch soil removal. Due to the larger numbers of cycles required for measurable starch removal, all of the tests with the melamine tiles utilized the automated dispenser to deliver the desired amount of detergent. In turn, full formulas were made into blocks in order to test the starch removal performance. The cleaning test was performed on two of the DM-77 and 2 of the DM-78 melamine tiles. After performing the test, the tiles were analyzed using a colorimeter to determine the percentage of soil removal. The percent soil removal was calculated by measuring the absorbance of the tile at 240 nm and comparing that to the initial absorbance of the tile as well as the absorbance of a clean tile.

Figure 2:
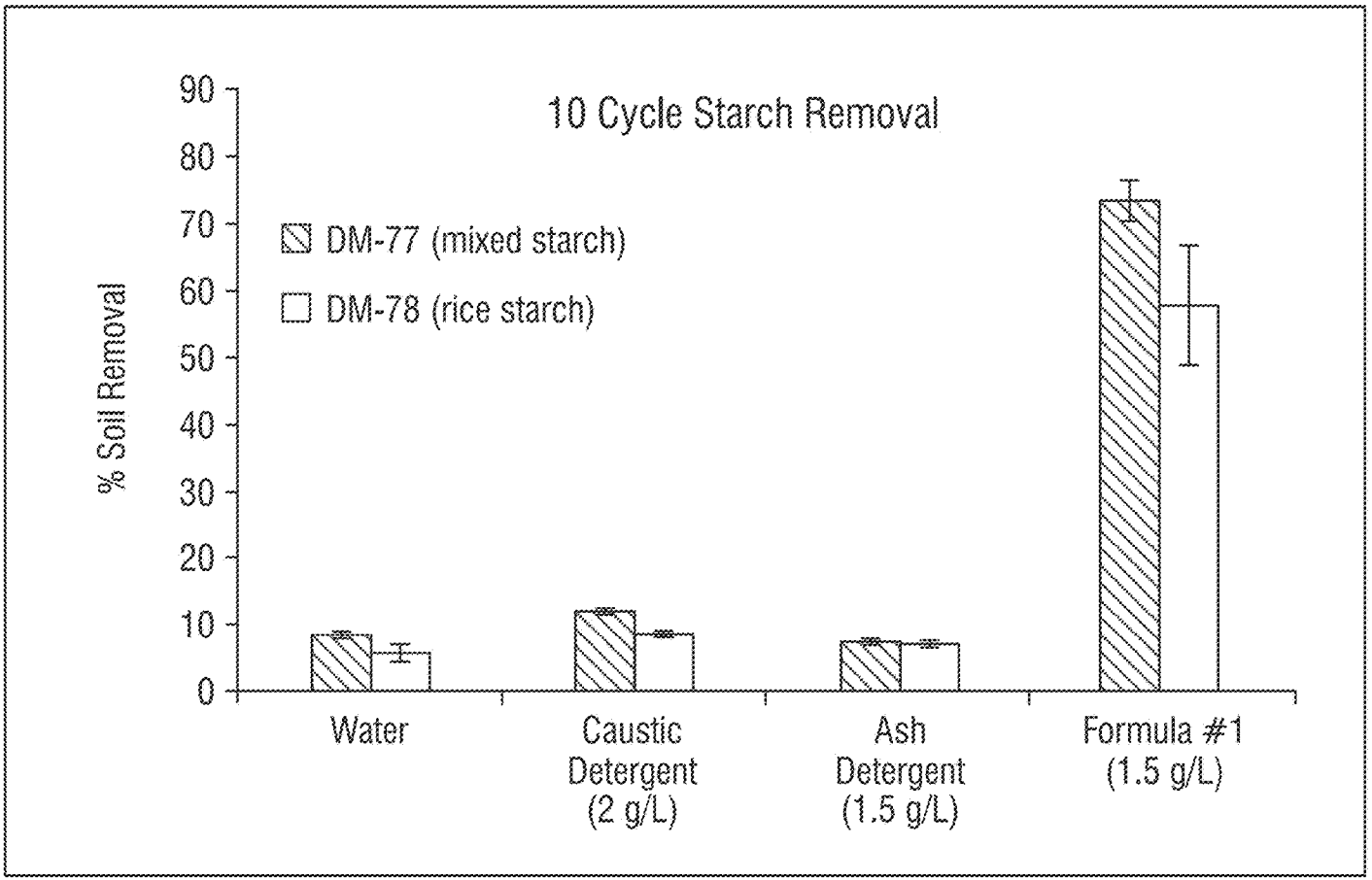

Table 4 and Table 5 and FIGS. 1 and 2 show the starch removal performance for 50 cycles and 10 cycles respectively. The results demonstrate that experimental formula 1 (Table 1) containing percarbonate and catalyst has significantly higher starch removal performance than water, 2000 ppm of caustic detergent, or 2500 ppm of ash detergent.

The ash detergent was a composition comprising 8.55% by weight water, 0.45% by weight potassium hydroxide, 72.33% by weight sodium carbonate, 7.5% by weight sodium citrate, 5.7% by weight surfactant (block copolymer based on ethylene oxide and propylene oxide), 3% by weight polyacrylate, 0.58% by weight ATMP, and 2% by weight sugar.

Even a 500 ppm dose of experimental formula 1 shows nearly complete starch removal after 50 cycles. Furthermore, much of the starch was able to be removed after only 10 cycles with a 1500 ppm dose of the full formula. After 10 cycles, there was almost no difference between the tiles washed with water and tiles washed with the caustic or ash detergents.

TABLE 4

Percentage of starch removal determined in a 50 cycle starch removal test on DM-77 or DM-78 test tiles using different detergent formulas.

| | Test tiles | |
|---|---|---|
| | DM-77 | DM-78 |
| Water | 10.3 ± 0.1 | 5.0 ± 0.4 |
| Caustic Detergent (2 g/L) | 17.1 ± 2.7 | 9.5 ± 0.8 |
| Ash Detergent (2.5 g/L) | 7.4 ± 0.1 | 2.8 ± 0.2 |
| Experimental Formula 1 (1.0 g/L) | 89.9 ± 2.1 | 80.8 ± 0.7 |
| Experimental Formula 1 (0.5 g/L) | 83.9 ± 2.2 | 74.3 ± 0.9 |

TABLE 5

Percentage of starch removal determined in a 10 cycle starch removal test on DM-77 or DM-78 test tiles using different detergent formulas.

| | Test tiles | |
|---|---|---|
| | DM-77 | DM-78 |
| Water | 8.5 ± 0.5 | 5.9 ± 1.3 |
| Caustic Detergent (2 g/L) | 12.1 ± 0.5 | 8.8 ± 0.4 |
| Ash Detergent (1.5 g/L) | 7.5 ± 0.4 | 7.3 ± 0.4 |
| Experimental Formula 1 (1.5 g/L) | 73.3 ± 3.1 | 57.8 ± 8.9 |

The invention claimed is:

1. A concentrated detergent composition comprising:

from about 15% to about 70% by weight of an alkali metal carbonate, from about 36% by weight to about 60% by weight of an alkali metal percarbonate, from 0.0005 to 0.12% by weight of the metal M in the form of a peroxidation catalyst according to formula (I)

$$[(L_pM_q)_nX_r]Y_s \quad \text{(I);}$$

from about 1.5% to about 15% by weight of one or more surfactants; and from about 2% to about 10% by weight of water, wherein the composition is a solid block and provides a pH of from about 8 to about 10.5 when diluted in distilled water at a concentration of 1 g/l;

wherein each L independently is an organic ligand containing at least three nitrogen atoms and/or at least two carboxyl groups that coordinate with the metal M;

M is Mn or Fe;

each X independently is a coordinating or bridging group selected from the group consisting of $H_2O$, $OH^-$, $SH^-$, $HO_2^-$, $O^{2-}$, $O_2^{2-}$, $S^{2-}$, $F^-$, $Cl^-$, $Br^-$, $I^-$, $NO_3^-$, $NO_2^-$, $SO_4^{2-}$, $SO_3^{2-}$, $PO_4^{3-}$, $N_3^-$, $CN^-$, $NR_3$, $NCS^-$, RCN, $RS^-$, $RCO_2^-$, $RO^-$, and

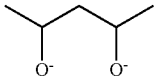

with R being hydrogen or a $C_1$ to $C_6$ alkyl group;

p is an integer from 1 to 4;

q is an integer from 1 to 2;

n is an integer from 1 to 4;

r is an integer from 0 to 6;

z denotes the charge of the complex $[(L_pM_q)_nX_r]$;

Y is a counter ion;

and s is the number of counter ions.

2. The concentrated detergent composition according to claim 1, wherein the peroxidation catalyst is a complex according to formula (II)

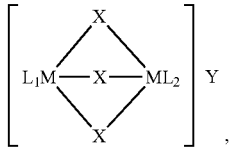

(II)

wherein $L_1$ and $L_2$ can either be separate ligands or where $L_1$ and $L_2$ can combine to be a single molecule.

3. The concentrated detergent composition according to claim 2, wherein Y is selected from the group consisting of $Cl^-$, $Br^-$, $I^-$, $No_3^-$, $ClO_4^-$, $NCS^{31}$ , $BPh_4^-$, $BF_4^-$, $PF_6^-$, $R^2—SO_3^-$, $R^2—SO_4^-$, and $R^2—CO_2^-$, wherein $R^2$ is hydrogen or a $C_1$ to $C_4$ alkyl group.

4. The concentrated detergent composition according to claim 2, wherein L is a ligand according to formulae (II) to (IV)

(II)

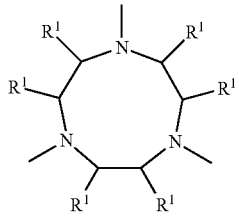

(III)

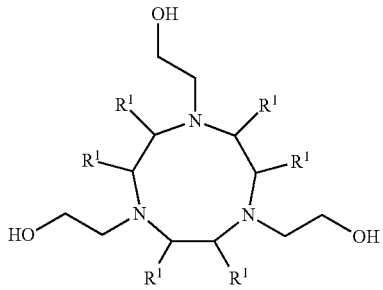

(IV)

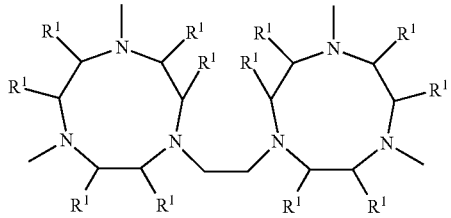

wherein each $R^1$ is independently selected from the group consisting of hydrogen and $C_1$-$C_6$ alkyl.

5. The concentrated detergent composition according to claim 4, wherein Y is selected from the group consisting of $Cl^-$, $Br^-$, $I^-$, $NO_3^-$, $ClO_4^-$, $NCS^-$, $BPh_4^-$, $BF_4^-$, $PF_6^-$, $R^2—SO_3^-$, $R^2—SO_4^-$, and $R^2—CO_2^-$, wherein $R^2$ is hydrogen or a $C_1$ to $C_4$ alkyl group.

6. The concentrated detergent composition according to claim 5, wherein the composition comprises 0.0005 to 0.12% by weight of the metal M in the form of a peroxidation catalyst complex.

7. The concentrated detergent composition according to claim 1, wherein L is a ligand according to formulae (II) to (IV)

(II)

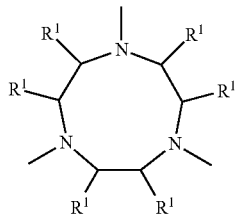

(III)

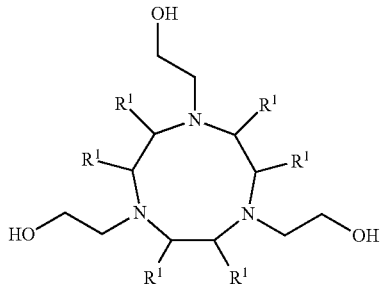

(IV)

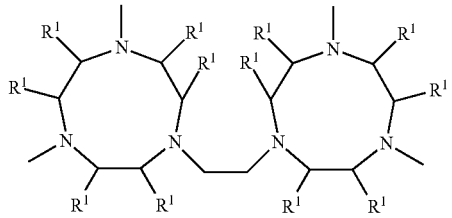

wherein each $R^1$ is independently selected from the group consisting of hydrogen and $C_1$-$C_6$ alkyl.

8. The concentrated detergent composition according to claim 1, wherein the composition comprises from 0.001 to 0.05% by weight of the metal M in the form of a peroxidation catalyst complex.

9. The concentrated detergent composition according to claim 1, wherein the composition comprises 20% to 60% by weight of the alkali metal carbonate.

10. The concentrated detergent composition according to claim 1, wherein the composition provides a pH of from about 9.5 to 10.5 when diluted in distilled water at a concentration of 1 g/l.

11. The concentrated detergent composition according to claim 1, wherein the composition further comprises at least one of surfactants, activating agents, chelating/sequestering agents, silicates, detergent fillers or binding agents, defoaming agents, anti-redeposition agents, enzymes, dyes, odorants, or mixtures thereof.

12. The concentrated detergent composition according to claim 1, wherein the surfactant is a nonionic surfactant.

13. A ware wash method for the removal of starch soil comprising applying of the concentrated detergent composition, according to claim 1, on wares.

14. The method according to claim 13, wherein the concentrated detergent composition is diluted to provide a solution with a concentration of 0.1 to 10 g/l.

15. The method according to claim 13, wherein the concentrated detergent composition is applied at a temperature of 20 to 85° C.

16. The method according to claim 13, wherein the concentrated detergent composition is applied for a washing time of 10 seconds to 5 minutes.

17. A concentrated detergent composition comprising from about 10% to about 80% by weight of an alkali metal carbonate, from about 36% to about 60% by weight of an alkali metal percarbonate, from 0.0005 to 0.12% by weight of the metal M in the form of a peroxidation catalyst according to formula (II);

from about 1.5% to about 15% by weight of one or more surfactants; and from about 2% to about 10% by weight of water, wherein the composition is a solid block and provides a pH of from about 8 to a bout 10.5 when diluted in distilled water at a concentration of 1 g/l;

(II)

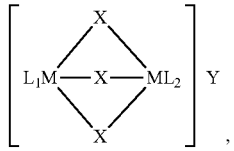

wherein L1 and L2 can either be separate ligands or where L1 and L2 can combine to be a single molecule, wherein M is Mn or Fe;

each X independently is a coordinating or bridging group selected from the group consisting of $H_2O$, $OH^-$, $SH^-$, $H_2O^-$, $O^{2-}$, $(O_2)^{2-}$, $S^{2-}$, $F^-$, $Cl^-$, $Br^-$, $I^-$, $(NO_3)^-$, $(NO_2)^-$, $(SO_4)^{2-}$, $(SO_3)^{2-}$, $(PO_4)^{3-}$, $(N_3)$, $CN^-$, $NR_3$, $NCS^-$, RCN, $RS^-$, $(RCO_2)^-$, $RO^-$, and

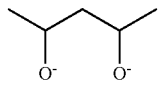

with R being hydrogen or $C_1$ to $C_6$ alkyl group;

Y is a counter ion.

* * * * *